US008485328B2

(12) United States Patent
Valcarenghi

(10) Patent No.: US 8,485,328 B2
(45) Date of Patent: Jul. 16, 2013

(54) TRAVEL ACCESSORY FOR THE FOLDING OF GARMENTS AND SUITCASE OBTAINED WITH SAID ACCESSORY

(75) Inventor: Luca Valcarenghi, Varese (IT)

(73) Assignee: Armeria Meschieri S.A.S. di Luca Valcarenghi & C., Milan (IT)

( * ) Notice: Subject to any disclaimer, the term of this patent is extended or adjusted under 35 U.S.C. 154(b) by 191 days.

(21) Appl. No.: 13/054,996

(22) PCT Filed: Jul. 20, 2009

(86) PCT No.: PCT/IB2009/053133

§ 371 (c)(1),
(2), (4) Date: Jan. 20, 2011

(87) PCT Pub. No.: WO2010/010503

PCT Pub. Date: Jan. 28, 2010

(65) Prior Publication Data

US 2011/0120824 A1 May 26, 2011

(30) Foreign Application Priority Data

Jul. 21, 2008 (IT) ..... MI20080230 U

(51) Int. Cl.
*A45C 5/03* (2006.01)
*A47G 25/00* (2006.01)

(52) U.S. Cl.
USPC ..... 190/102; 206/286; 223/98

(58) Field of Classification Search
USPC ..... 206/286, 292, 293; 223/87, 98, 37, 223/66, 68, 71, 72, 88; 190/102, 110
See application file for complete search history.

(56) References Cited

U.S. PATENT DOCUMENTS

| | | | | |
|---|---|---|---|---|
| 1,769,216 | A * | 7/1930 | Foote | 223/98 |
| 1,951,985 | A * | 3/1934 | Likly | 223/68 |
| 2,169,552 | A * | 8/1939 | Bellin | 223/68 |
| 2,521,250 | A * | 9/1950 | Pence | 223/98 |
| 2,590,811 | A * | 3/1952 | Zimmerman et al. | 8/128.1 |
| 2,813,667 | A | 11/1957 | Gross | |
| 2,828,899 | A * | 4/1958 | Zuckerman | 223/98 |
| 3,064,866 | A * | 11/1962 | Sage | 223/87 |
| 3,179,315 | A * | 4/1965 | Sieradzki | 223/98 |
| 3,847,314 | A * | 11/1974 | Florian | 223/98 |
| 4,126,252 | A | 11/1978 | Wasserman | |
| 5,779,111 | A | 7/1998 | Ball | |
| 6,267,275 | B1 * | 7/2001 | Murray | 223/98 |
| 2006/0049221 | A1 * | 3/2006 | Hanrahan | 223/85 |
| 2006/0175364 | A1 * | 8/2006 | Simpson et al. | 223/98 |
| 2007/0142814 | A1 | 6/2007 | Akselrod et al. | |
| 2008/0120881 | A1 * | 5/2008 | Rhinehart et al. | 40/665 |

OTHER PUBLICATIONS

International Search Report, dated Mar. 29, 2010, from corresponding PCT application.

* cited by examiner

*Primary Examiner* — Sue A Weaver
(74) *Attorney, Agent, or Firm* — Young & Thompson

(57) ABSTRACT

A travel accessory for the folding of garments inside a suitcase, includes at least one structural element for spreading and/or hanging (1) and an insert (2) of a soft, flexible material, designed to be inserted into the garment, engaged with the structural element (1).

19 Claims, 2 Drawing Sheets

TRAVEL ACCESSORY FOR THE FOLDING OF GARMENTS AND SUITCASE OBTAINED WITH SAID ACCESSORY

FIELD OF THE INVENTION

The present invention relates to a travel accessory for the folding of garments, in particular for the folding of clothes inside a suitcase.

BACKGROUND

As known, one of the most difficult problems experienced by travelers is how to put their clothes in suitcases in such a way that they are transported without suffering too many creases. It is, in fact, known that there is a conflict between the requirement to transport folded clothes without their taking up too much room, and at the same time, without compressing them unduly, in order to avoid producing deep wrinkles and folds. This problem is particularly acute in the case of people who travel for work, with elegant, light-weight clothes (for example, a man's suit made of light-weight Tasmania fabric), because the two requirements cited above are particularly stringent.

According to the known art, a plurality of solutions has been offered, based substantially on the use of rigid or semi-rigid suitcases. Various accessories are available, which can be put into suitcases in order to fold the clothes and hold them in place, without compressing the fabrics, which would inevitably produce unpleasant deep creases.

In other cases, padded elements have been proposed, some of which are of a highly complex shape, with predetermined folding lines, on the outside of which the garment is folded.

These accessories, however, are in the form of compressible cushions, plates or bags, which are semi-rigid in some cases and which, in themselves, take up space inside the suitcase, thereby restricting its capacity. It is, in fact, considered, in the known art, that the operative principle of an anti-creasing device is substantially to connect, with broad radii of curvature, the area in which the garment is folded, thereby preventing the formation of small radiuses of curvature which, under pressure, would cause permanent creases.

As a result, the accessories offered by the known art thus far are intrinsically bulky. Further many of them provide predetermined folding lines, which make it difficult to use or to be matched to the clothes, especially if the cut of the garment does not correspond exactly to that provided for by the accessory.

It should also be pointed out that these accessories are normally configured for a specific type of suitcase and are therefore unsuitable for universal, generalised use.

The object of the present invention is therefore to overcome these problems, by providing an accessory which is efficacious but with a very small bulk and cost, and which can be used conveniently and universally, for the support and folding of garments inside suitcases.

SUMMARY OF THE INVENTION

Said object is achieved by means of a device, the basic features of which are described in the attached main claim.

Other innovative aspects of the device are described in the dependent claims.

In particular, according to a first aspect of the invention, a travel accessory is provided for the folding of garments inside a suitcase, comprising at least one structural element for spreading and/or hanging, and an insert made of a soft, flexible material, designed to be inserted into said garment and engaging with said structural element. According to an aspect of the invention, the insert consists of at least one sheet of soft, flexible material, preferably two paired sheets, with a total thickness of about 0.5 mm to approximately 10 mm and preferably between 0.8 and 1.2 mm per individual sheet.

According to a further aspect, when the insert is composed of two paired sheets, they are joined at least along a welding line, in such a way as to form a type of envelope, the structural element being simply inserted between the two paired sheets and abutting the welding line.

According to a third aspect, the insert has an outline substantially corresponding to that of the garment into which it is to be inserted.

According to a fourth aspect of the invention, the insert is made of foamed polyethylene or polyurethane, or a soft natural or semi-natural material such as a woven or nonwoven woollen-based fabric, terrycloth or pile or fabric.

According to a fifth aspect of the invention, the insert made of soft, flexible material has no predetermined fold lines. Finally, according to a final aspect of the invention, a suitcase is provided for garments, comprising an openable housing inside which an accessory as described above is installed.

BRIEF DESCRIPTION OF THE DRAWINGS

Further characteristics and advantages of the device according to the invention will become more apparent from the following detailed description, which is provided by way of example and illustrated in the attached drawings, wherein.

DETAILED DESCRIPTION OF THE PREFERRED EMBODIMENTS

The Applicant, through extensive experimentation, has been able to ascertain that, differently from what was believed in the field, it is not strictly necessary to ensure broad radii of curvature when folding clothes, in order to avoid the formation of creases. It has, in fact, been found that even slight thicknesses of soft, flexible padding, placed in correspondence to the area of folding of the garment, but inside said garment, enable one to avoid the formation of permanent creases.

Consequently, according to the invention, an anti-crease accessory is composed of a spreading and/or hanging structural element 1, such as a coat hanger, to which is coupled (optionally removably, as will be seen hereinafter) an insert 2, made of soft, flexible material (FIG. 1) and intended to be inserted into the garment.

Preferably, insert 2 comprises a sheet of flexible material having the same outline as that of the garment for which it is intended, or rather, corresponding to the internal profile of the garment in its flattened state (front and back), but not folded. Accordingly, if the garment to be folded is a jacket, the insert will preferably have a substantially rectangular central portion 2*a*, which is inserted into the torso area of the jacket and from which two lateral arms 2*b* project, which are inserted into the sleeves of the jacket. A similar insert can be used for shirts and blouses. Conversely, if the garment to be folded is a pair of trousers, the insert will substantially consist of two slightly divergent arms, joined at a common portion in an area at the extremity, intended to be inserted into the two legs of the trousers.

Each insert 2 may consist of a single, thin sheet, fixed to said hanging and spreading structural element 1 in some way (for example, temporarily by means of clips, clamps or staples or, permanently, by means of gluing, welding ans so on) along a junction line 1*a*.

Alternatively, said insert 2 can consist of two paired sheets 2' and 2", in which case the two paired sheets are designated to be held together (by gluing, welding, stitching etc.) at least along the edge intended to co-operate with said structural element 1, which could simply be inserted (advantageously also removably) between the two sheets and held in that junction zone, without the need for further fastening means. Basically, according to a preferred embodiment (FIG. 2), the two sheets are superimposed on each other and joined at least along a welding line to form a type of envelope, into which said structural element 1 is simply inserted until it abuts an upper edge area, where said welding line is provided, in a position corresponding to the shoulders of the garment.

Figure 2:
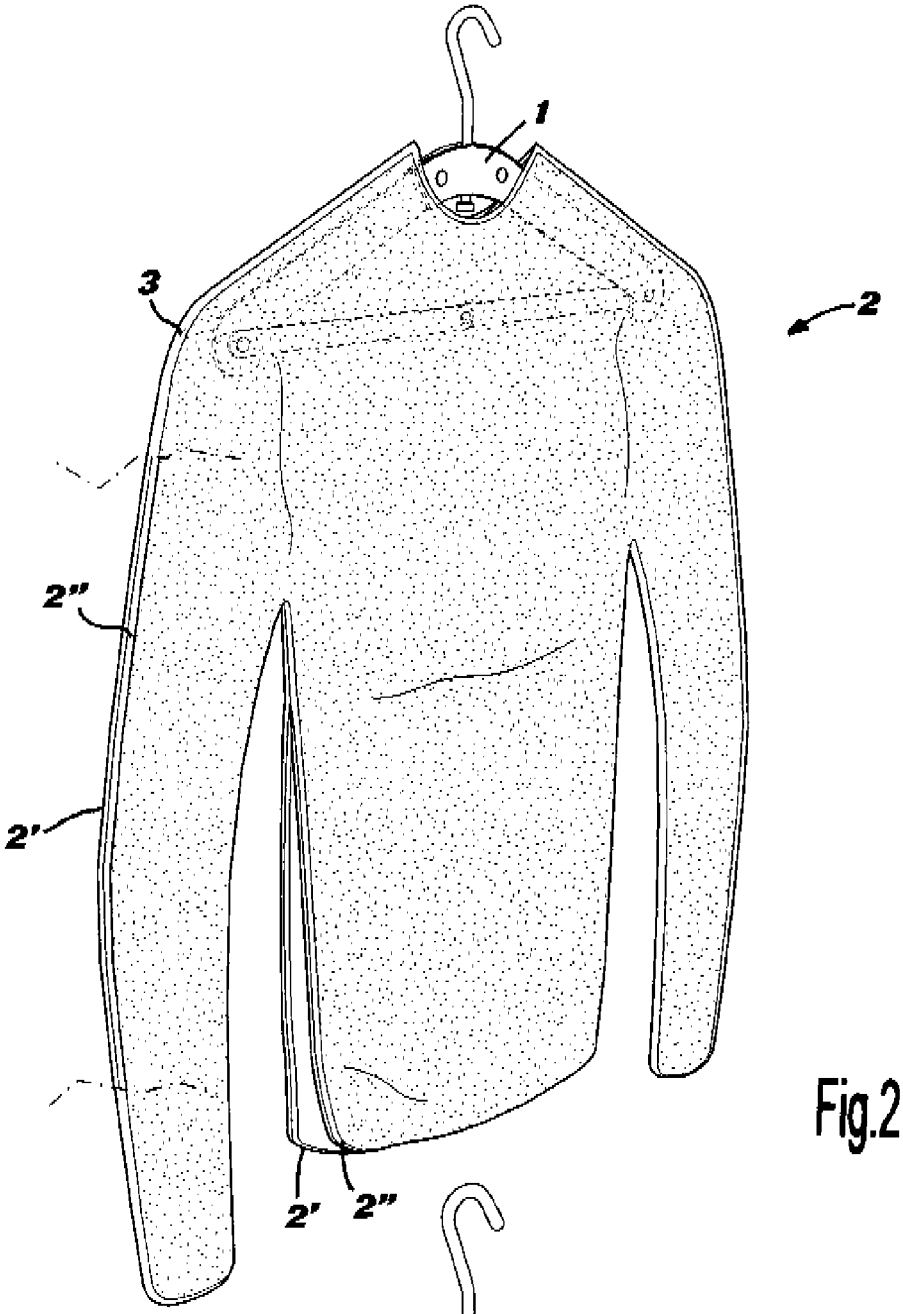
FIG. 2 is a partially-interrupted perspective view of a second embodiment of the invention.
Figure 3:
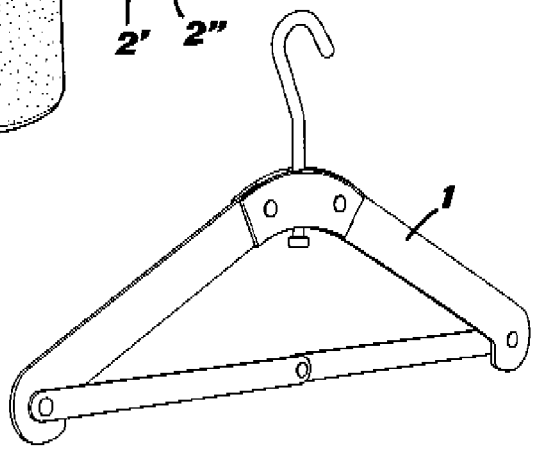
FIG. 3 is a perspective view of a exemplary spreading element of the invention.

In the embodiment shown in FIG. 2, the two sheets are joined over the entire perimeter, except for a lower area and on one side, right up to a position below the arm attachment, into which said coat hanger 1 can be inserted, or from which it can be extracted.

The two sheets can be joined together along part of their perimeter, by means of welding, stitching or some other suitable method, preferably finishing off the margins of the sheets with a folded binding 3, in the form of a small border, which improves the aesthetic appearance of the product and protects the thin edge of the sheet against ripping, fraying and wear.

Should one wish to join up the entire perimeter of the two sheets, said structural element 1 must be inserted between the two sheets, before completing the welding line.

Insert 2 consists, by way of example, of sheets of foamed polyethylene, both with closed cells and, preferably, with open cells (polyphrene); alternatively, one can use sheets made of other foamed plastic materials, such as foamed polyurethane, or soft natural or semi-natural materials, such as, for example, woven or nonwoven woollen-based fabrics, terrycloth, pile and so forth.

Sheets of polyethylene or polypropylene bubble wrap (pluriboll) could also be used, provided that the bubbles are of very small diameter (less than 5 mm) in order to ensure that the sheet is soft and flexible enough.

Figure 1:
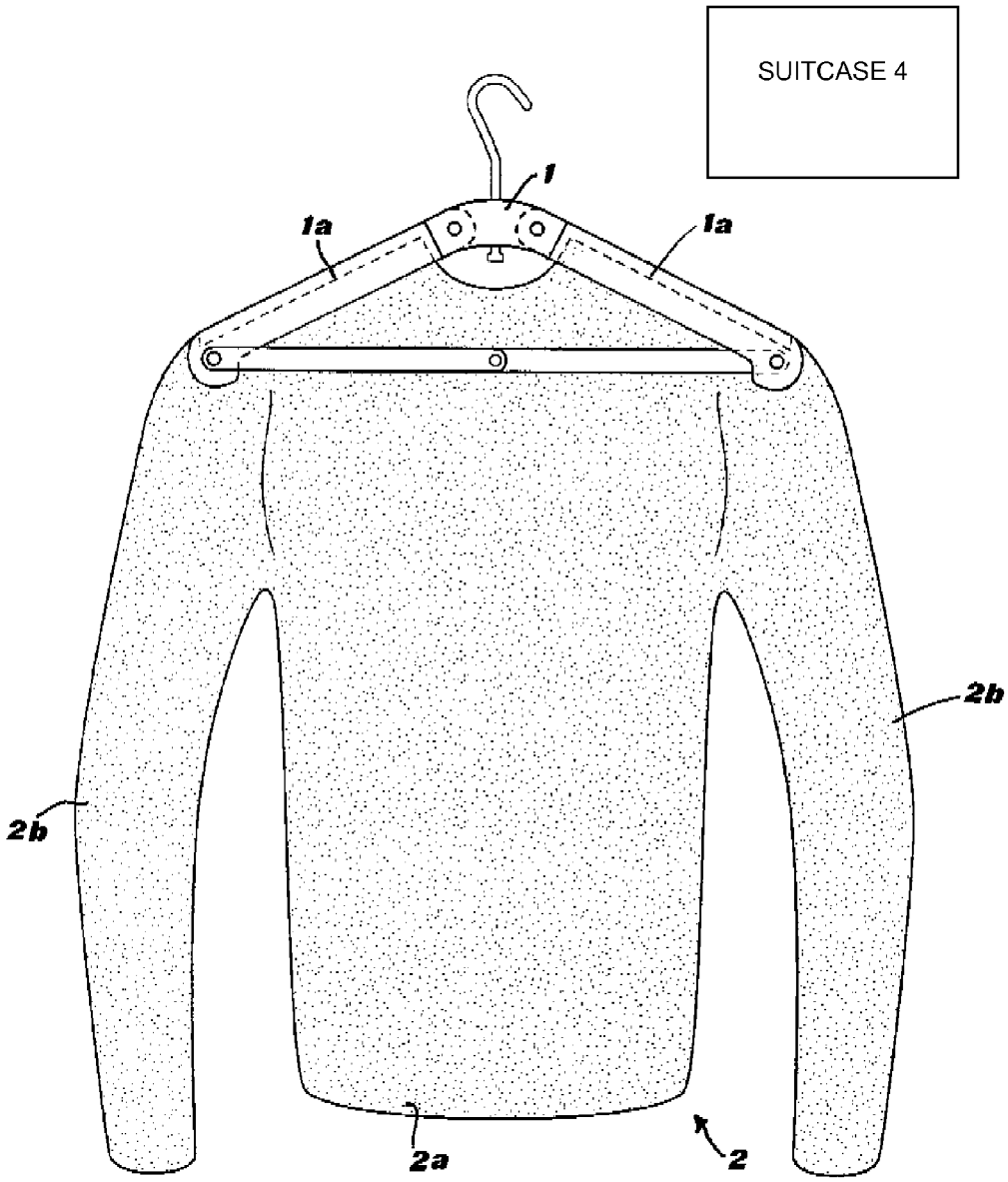
FIG. 1 is a plan view of a first embodiment of the invention.

The total thickness of the insert (and therefore of the individual sheet or of the sum of the two paired sheets) must be sufficient to act as slight padding—in such a way as to absorb, locally and from the inside of the garment, pressure which would tend to crease the garment—but not to such an extend as to take up an undesirable amount of room in the suitcase 4 (shown schematically in FIG. 1). Typical thicknesses appropriate to the purpose, depending on the material, are approximately 0.5 mm to approximately 10 mm, preferably between 0.8 mm and 1.2 mm for each individual sheet.

Advantageously, because they are not necessary and are even counterproductive in some respects, no predetermined folding lines is provided on the surface of said insert 2.

Said hanging and/or spreading element 1 is preferably made in such a way as to be removable or foldable, in order to make the entire accessory easily collapsible, so that it can be tidied away into a small space, when not in use. For that purpose, the transverse portions can be reciprocally hinged (in the way shown schematically in FIG. 1, or also in a different way), in order to enable them to be folded away one on top of the other. Should the accessory assume the shape of a coat hanger, it is preferable for its hook, as well—which is designed to hook it onto a clothes rail, inside a wardrobe, for example—to be either of a collapsible type or mounted pivotably on its plane, in such a way that it can be hidden or folded away inside the garment when it is put into the suitcase.

According to one embodiment of the invention, said flexible insert 2 constitutes a permanent suitcase accessory; in that case, said spreading element 1 can be a device integral with and hinged to the suitcase.

Whilst the original purpose of said insert 2 is to prevent the formation of permanent creases, by acting efficaciously from inside of the garment, the first, primary function of said hanging and/or spreading element 1 is to keep the garment stretched, at least at the initial stage of insertion into the suitcase, thereby preventing further accidental folding in a direction transverse to its main axis. Accordingly, said structural element has a substantially rigid configuration.

As a second primary function, said spreading element 1, when engaged with said flexible insert 2, renders the latter easier to handle and insert into the garment; in fact, because of its flexibility and softness, said insert 2 would otherwise be difficult to be inserted and positioned as desired inside the garment. From this point of view, said stretching element 1 could possibly be designed solely for initial use and then removed once the garment has been put into the suitcase. The spreading element 1 is hence removable from the flexible insert 2.

In use, when one has to put a garment back into a suitcase, it is sufficient to insert said structural element 1 into the garment (for example, by inserting the coat hanger into the shoulders of a jacket in the conventional way) to which said insert 2 is connected and which is therefore partially drawn inside the garment: after which, with the garment open, insertion of the various portions of which said insert 2 is composed is completed.

At this point, the garment can easily be folded—along the desired folding lines, substantially aligned with the direction of rigidity of said structural element 1—and put into a suitcase.

The very slight thickness and flexibility/softness of said insert 2 cause the accessory according to the invention to take up very little room inside the suitcase, with the result that the capacity thereof is not affected by it. Even when the suitcase is filled with various garments, the pressure which occurs in its interior once it is closed cannot give rise to significant permanent folds in the garment which is provided with the accessory according to the invention.

Advantageously, the accessory proposed herein is of the universal type and does not depend on the specific suitcase used. However, it is not excluded that a structural element 1 could possibly be developed especially to match with a specific suitcase (not shown) of which it would form a proprietary accessory.

Lastly, the simple composition and economy of production of the materials used are such that the device according to the invention is very economical, to the extent that it can be offered as a mass-produced accessory, at no extra cost, to purchasers of clothing. The wide area available on the insert also makes it possible for decorative motifs or advertising logos to be printed on it.

It is understood that protection of the invention described above is not limited to the particular embodiment illustrated, but is extended to all other structural variants which come under the definition proposed in the attached claims.

The invention claimed is:

1. Travel accessory for the folding of a garment inside a suitcase, comprising:

a spreading and/or hanging structural element (1); and an insert (2) made of soft, flexible material designed to be inserted into said garment and engaged with said structural element (1), said insert (2) consisting of exactly two sheets of soft, flexible material (2', 2"), paired together.

2. Accessory as in claim 1, wherein each sheet has an overall thickness of between approximately 0.5 mm and approximately 10 mm.

3. Accessory as in claim 2, wherein said two paired sheets are joined together, at least along a welding line, in such a way as to form a kind of envelope, said structural element (1) being simply inserted between the two paired sheets and abutting against said welding line.

4. Accessory as in claim 1, wherein said insert (2) has an outline substantially corresponding to that of the garment into which it is to be inserted, each of the two sheets including a central torso portion (2*a*) from which two lateral arm portions (2*b*) project corresponding to arm portions of the garment.

5. Accessory as in claim 1, wherein said insert (2) is made of foamed polyethylene, of the closed-cell or open-cell type.

6. Accessory as in claim 1, wherein said insert (2) is made of foamed polyurethane.

7. Accessory as in claim 1, wherein said insert (2) is of soft natural or semi-natural material.

8. Accessory as in claim 1, wherein said insert (2) is made of terrycloth fabric.

9. Accessory as in claim 1, wherein said insert (2) is made of pile or fleece fabric.

10. Travel accessory as in claim 1, where said insert (2), made of soft, flexible material, is devoid of predetermined folding lines.

11. Suitcase for garments, comprising an openable housing within which an accessory as in claim 1 is installed.

12. Accessory as in claim 1, wherein said insert (2) is of woolen-based fabric.

13. Accessory as in claim 1, wherein each sheet has the overall thickness of between 0.8 mm and 1.2 mm.

14. Travel accessory for the folding of a garment inside a suitcase, consisting essentially of:

a hanging structural element (1); and an insert (2) made of soft, flexible material shaped to be inserted into the garment and engaged with said structural element (1), said insert (2) consisting of exactly two sheets of soft, flexible natural or semi-natural material (2', 2"), paired together and defining an envelope, each sheet having an overall total thickness of between approximately 0.5 mm and approximately 10 mm, each of the two sheets including a central torso portion (2*a*) from which two lateral arm portions (2*b*) project corresponding to arm portions of the garment, the structural element (1) being inserted between the two paired sheets (2', 2").

15. Accessory as in claim 14, wherein said insert (2) is made of a fabric.

16. Accessory as in claim 14, wherein each sheet has the overall total thickness of between 0.8 mm and 1.2 mm.

17. Accessory as in claim 15, wherein each sheet has the overall total thickness of between 0.8 mm and 1.2 mm.

18. Travel accessory for the folding of a garment inside a suitcase, comprising:

a hanging structural element (1); and an insert (2) made of soft, flexible material shaped to be inserted into the garment and engaged with said structural element (1), said insert (2) comprising two sheets of soft, flexible material (2', 2"), paired and attached together and defining an envelope, each sheet having an overall total thickness of between approximately 0.5 mm and approximately 10 mm, each of the two sheets including a central torso portion (2*a*) from which two lateral arm portions (2*b*) project corresponding to arm portions of the garment, the structural element (1) being inserted between the two paired sheets (2', 2").

19. Accessory as in claim 18, wherein each sheet has the overall total thickness of between 0.8 mm and 1.2 mm.

* * * * *